United States Patent [19]

Takita et al.

[11] Patent Number: 4,619,224

[45] Date of Patent: Oct. 28, 1986

[54] APPARATUS FOR CONTROLLING DRUM WATER LEVEL OF DRUM TYPE BOILER

[75] Inventors: Atsushi Takita, Mito; Akira Sugano, Katsuta; Naganobu Honda, Hitachi, all of Japan

[73] Assignee: Hitachi, Ltd., Tokyo, Japan

[21] Appl. No.: 765,437

[22] Filed: Aug. 14, 1985

[30] Foreign Application Priority Data

Aug. 17, 1984 [JP] Japan ..... 59-172190

[51] Int. Cl.[4] ..... F22D 5/26

[52] U.S. Cl. ..... 122/451 R; 122/488; 122/451 S

[58] Field of Search ..... 122/451 R, 451 S, 488

[56] References Cited

U.S. PATENT DOCUMENTS

| | | | |
|---|---|---|---|
| 3,518,974 | 7/1970 | Bradley | 122/451 R |
| 3,780,705 | 12/1973 | LeFebue de Vivy | 122/451 R |
| 4,242,989 | 1/1981 | Chamberlain | 122/451 R |
| 4,258,668 | 3/1981 | Bekedam | 122/451 R |
| 4,465,027 | 8/1984 | Steinegger | 122/451 R |
| 4,520,762 | 6/1985 | Martin | 122/451 S |

FOREIGN PATENT DOCUMENTS 56-87703 7/1981 Japan .

*Primary Examiner*—Henry C. Yuen

*Attorney, Agent, or Firm*—Antonelli, Terry & Wands

[57] ABSTRACT

An apparatus for controlling the drum water level of a drum boiler prevents the boiler system from being tripped off which would otherwise be caused by an excessive fall in the drum water level immediately after the start of load runback, by increasing the real feed water flow rate in such a manner that a feed water flow rate demand signal obtained from the drum water level deviation is corrected by a feed water flow rate increment signal obtained from the amount of load reduction (load demand—load reference after load runback) at the time of load runback. In addition, the fact that the drum water level stops falling and starts to rise is detected, and the feed water flow rate demand signal is adjusted so as to take a medium value between the real feed water flow rate and the real main steam flow rate, thereby preventing the boiler system from being tripped off which would otherwise be caused by an excessive rise in the drum water level.

6 Claims, 8 Drawing Figures

APPARATUS FOR CONTROLLING DRUM WATER LEVEL OF DRUM TYPE BOILER

BACKGROUND OF THE INVENTION

The present invention relates to an apparatus for controlling the drum water level in a drum boiler. More particularly, the invention pertains to a drum water level controlling apparatus which may be suitably employed to suppress a variation in the drum water level which occurs when the load changes rapidly and by a large margin, for example, at the time of load run back.

Drum boilers are widely employed as boilers for thermal power generation. The water/steam system in a thermal power plant which employs a drum boiler is generally arranged as follows. In this type of boiler, water is fed into a drum by a feed water pump. The drum is further supplied with water and steam from a lower header through a riser tube which also serves as a water-wall tube. In the drum, water and steam are separated from each other, and the separated water is fed to the lower header through a downcomer. The steam which is generated in the drum is passed through a 1st superheater, an attemperator, a 2nd superheater and a turbine control valve and is then applied to the turbine so as to drive the same. The steam which has been used to drive the turbine is sent to a condenser where it is condensed into water. This water is supplied to the drum again through the above-described feed water pump. It is to be noted that the attemperator regulates the main steam temperature, that is, the temperature of the steam introduced into the turbine, by spraying the steam with a part of the water introduced thereto from the feed water pump.

It is important for this drum type boiler to control the water level within the drum. If the water level falls, the inside of the drum may be overheated, and this unfavorably causes the metal portion of the drum to melt and an abnormal pressure to be generated. A rise in the water level causes steam which has not been superheated to be introduced into the turbine, in which case, the metal portion of the turbine may be corroded. For this reason, when the water level abnormally varies in either case, the boiler system is tripped off. For the same reason, the water level control in a normal or ordinary state is effected within the range between limited water levels. More specifically, as also disclosed in the specification of Japanese Patent Laid-Open No. 87703/1981, the flow rate of feed water is controlled in accordance with a signal obtained by correcting the deviation of a real water level from a reference value for the water level by the main steam flow rate or the feed water flow rate. In this case, the main steam flow rate and the feed water flow rate act as anticipatory control signals so as to quicken the response time of the water level control system.

When an important auxiliary machine in the plant is out of order, load runback is carried out in which the load is rapidly and greatly reduced to the level at which the remaining auxiliary machines can continue the operation. However, in such load runback, the water level in the drum undesirably varies by a large margin, so that the water level may disadvantageously exceed the upper or lower limit value to reach a boiler trip level. This problem will be explained hereinunder in more detail.

When load runback is started, as is well known to those who are skilled in the art, the water level in the drum temporarily lowers and, therefore, the feed water flow rate is controlled such as to be increased through the proportional plus integral action. However, if the increase in the feed water flow rate is not adequate, the water level in the drum may fall to an abnormally low level, to the lower limit value to reach the boiler trip level (low trip level). It is considered that the above-described temporary lowering of the water level is caused by the fact that the pressure inside the drum is raised by the rapid throttling down of the turbine control valve which is effected by the load runback, thereby causing air bubbles contained in the water in the drum, the downcomer, the lower header and the riser tube to be compacted.

Even if the water level in the drum is saved from reaching the low trip level due to an increase in the feed water flow rate, the run down of the feed water flow rate effected by the proportional plus integral control cannot cope with a sudden rise in the drum water level after the load runback, so that there are many occasions where the water level undesirably rises in excess of the upper limit value to reach a boiler trip level (high trip level).

The load runback carried out in relation to the drum type boiler will be successful only when it overcomes both the rise and fall in the water level in the boiler.

SUMMARY OF THE INVENTION

It is a primary object of the present invention to provide an apparatus for controlling the drum water level in a drum type boiler which adjusts the flow rate of feed water in such a manner that the variation in the water level in the drum is minimized when the load is rapidly and greatly changed, for example, at the time of load runback.

In view of the fact that the water level in the drum falls rapidly at the beginning of load runback, while the water level rises rapidly after the load runback, the drum water level controlling apparatus according to the invention is arranged such that the flow rate of feed water is rapidly increased in accordance with the amount of load reduction at the beginning of load runback, thereby supressing the lowering in the water level in the drum, while after the water level has stopped falling and before it begins to rise, the flow rate of feed water is rapidly reduced to a medium value between the feed water flow rate and the main steam flow rate at the relevant time so as to supress the rise in the drum water level.

DESCRIPTION OF THE PREFERRED EMBODIMENT

Figure 1:
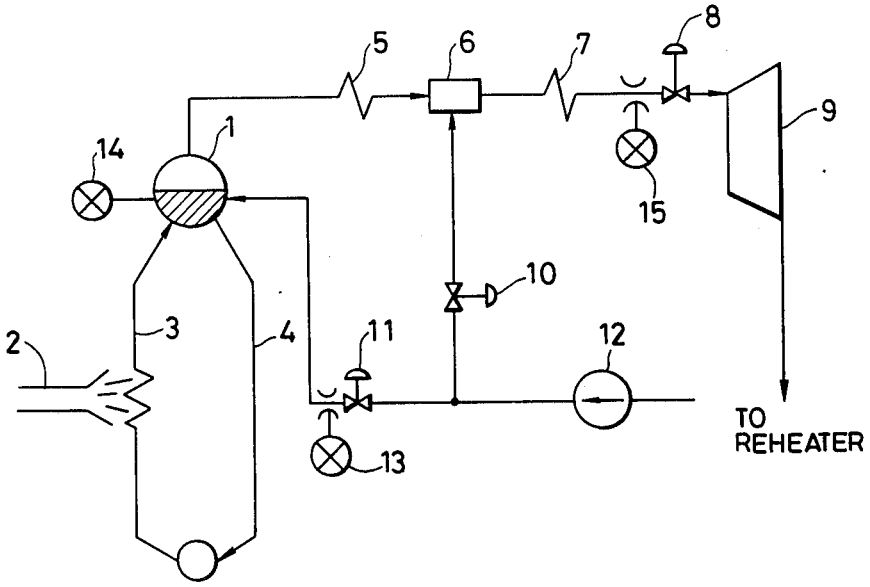
FIG. 1 PRIOR ART
FIG. 1 schematically shows the arrangement of a thermal power plant having a conventional drum type boiler to which the present invention is applied.

An outline of the arrangement of a thermal power plant having a drum type boiler to which the present invention is applied will first be described with reference to FIG. 1. This arrangement is the same as the conventional one.

In the Figure, the reference numeral 1 represents a boiler drum, 2 a burner, 3 a riser tube, 4 a downcomer, 5 a 1st superheater, 6 an attemperator, 7 a 2nd superheater, 8 a turbine control valve, 9 a turbine, 10 a spray valve, 11 a feed water valve, and 12 a feed water pump. The steam generated in the drum 1 is superheated in the 1st superheater 5 and has its temperature adjusted in the attemperator 6 and is then applied to the turbine 9 through the 2nd superheater 7 and the turbine control valve 8 so as to drive the turbine 9. The steam having been used to drive the turbine 9 is sent to a reheater. The attemperator 6 is supplied with spray water through the feed water pump 12 and the spray valve 10. The drum 1 is supplied with water from the feed water pump 12 through the feed water valve 11.

Figure 2:
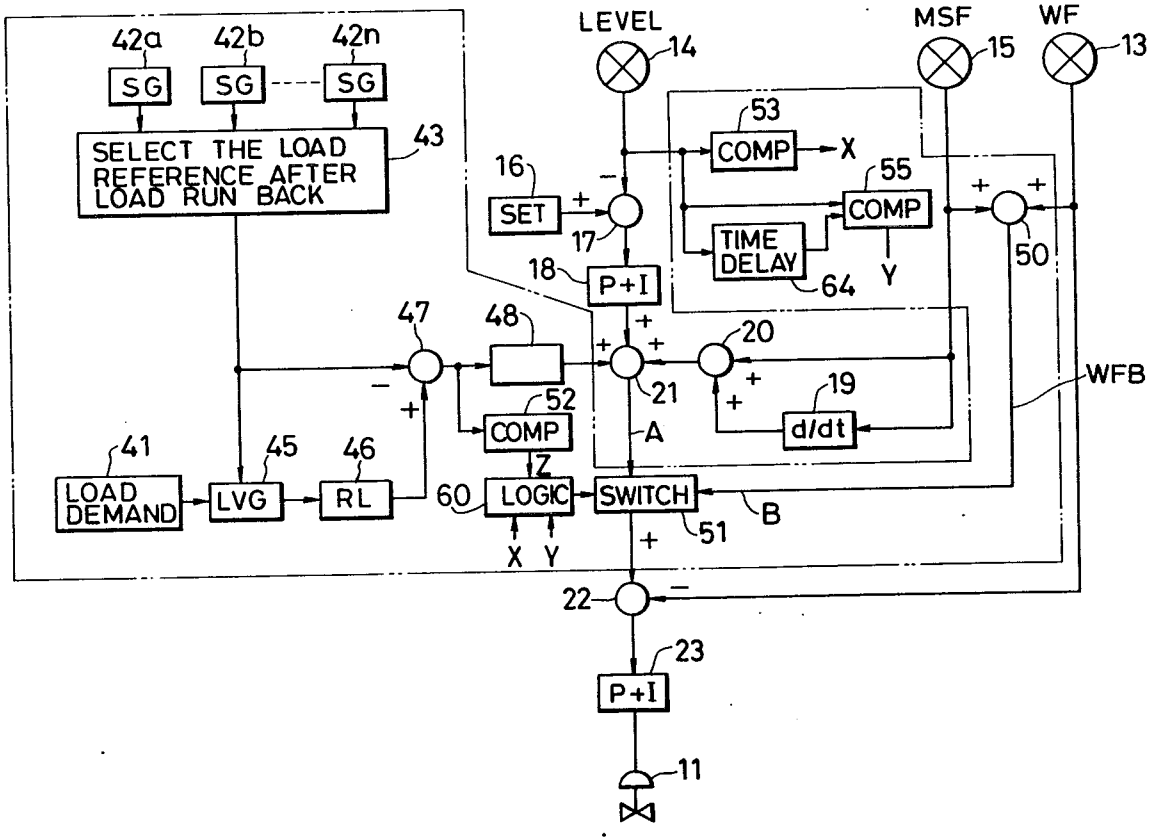
FIG. 2 shows one embodiment of a drum water level controlling apparatus according to the present invention.

Referring next to FIG. 2, there is shown one embodiment of the drum water level controlling apparatus according to the present invention. In this Figure, the portion surrounded by the chain line is a circuit portion which is additionally provided by the present invention. Prior to the description of this circuit portion, the conventional fundamental circuit portion will be explained. The detectors which are employed in the fundamental circuit portion include a feed water flow rate (WF) detector 13, a drum water level (LEVEL) detector 14 and a main steam flow rate (MSF) detector 15, as illustrated in FIG. 1. The feed water flow rate is finally controlled by adjusting, for example, the feed water valve 11. In this circuit portion, a signal from the drum water level detector 14 is compared with a signal from a water level setting device 16 by a subtractor 17, and the deviation output of the subtractor 17 is input to a proportional plus integral calculator 18. A signal from the main steam flow rate detector 15 is added to the rate of change of the main steam flow rate by a differentiator 19 and an adder 20. Thus, when the main steam flow rate changes, a feed-forward control is executed. The output signal of the adder 20 is supplied to an adder 21 where it is added to the output of the proportional plus integral calculator 18, the result being a command value for feed water flow rate. A subtractor 22 makes comparison between a signal from the feed water flow rate detector 13 and the command value. The deviation output of the subtractor 22 is input to a proportional plus integral calculator 23. The output of the proportional plus integral calculator 23 serves as a signal for actuating the feed water valve 11. This control system including such various steps provided on the basis of the main steam flow rate heightens the controllability of drum water level with respect to rapid load change.

The circuit portion, surrounded by the chain line, which is added by the present invention is arranged such that a plant load demand 41 and a load reference 42 after load runback are newly input thereto, and the feed water flow rate command value is corrected in accordance with these input values. The arrangement and operation of this circuit portion will be described hereinunder in detail.

The plant load demand 41 is obtained from, for example, the central load dispatching control station. The load references 42*a* to 42*n* after load runback are preset to correspond to various cases of load runback and are appropriately selected by a selector circuit 43.

In the ordinary operation state, the output of the selector circuit 43 is equal to the maximum value of the plant load demand 41. The output of the circuit 43 is a signal representing, for example, 100% load. The reference numeral 45 denotes a low value gate. That is, if a load reference, namely the output of the selector circuit 43, becomes lower than the load demand 41 during load runback, this load reference is selected. A rate of change limiter 46 restricts the rate of change of the load demand or the output of the low value gate 45. The changing rate is set at a higher value at the time of load runback than at normal times. A subtractor 47 subtracts the output of the selector circuit 43 from the output of the rate of change limiter 46. In a normal or ordinary state, the output of the selector circuit 43 is equivalent to 100% load, while the load demand 41 represents any load below 100% load. Hence, the output of the subtractor 47 is either negative or zero. At the time of load runback, the output of the selector circuit 43 is equivalent to, for example, 25% load, while the load demand 41 represents any load larger than 25% load. Hence, the output of the subtractor 47 is positive. There is a slight possibility that the load demand 41 will be less than the output of the selector circuit 43 at the time of load runback. However, if such a situation should occur, this means that no load runback is required. It is to be noted that the gain of the subtractor 47 may be set as desired. The reference numeral 48 denotes a signal limiter, in which the lower limit is set at zero, whereby a negative signal from the subtractor 47 is cut off. The output of the signal limiter 48 is added to the output of the proportional plus integral calculator 18 and that of the adder 20 by means of an adder 21. This total output is to be the feed water flow rate demand. In this case, the output of the signal limiter 48 represents the result of subtraction, the load demand—the selected load reference after load runback ($\geqq 0$), that is, the difference between the loads before and after load runback (the amount of load reduction). As will be clear from the above description, the output of the signal limiter 48 is positive at the beginning of load runback and serves as a demand signal for increasing the feed water flow rate in correspondence with the amount of load reduction. This flow rate incremental demand signal is generated only in a transient stage of load runback to increase the feed water flow rate. It is therefore possible to suppress the lowering in the drum water level at the time of load runback and prevent the boiler system from being tripped off.

According to the present invention, the flow rate incremental demand signal is also prepared by employing the deviation or difference between the feed water flow rate and the main steam flow rate. The reference numeral 50 in FIG. 2 denotes an adder which forms a demand signal by which the feed water flow rate is set at a medium value between the feed water flow rate and the main steam flow rate at the relevant time.

Namely, $$WFD = (WF - MSF) \times \beta + MSF$$

-continued $$= WF \times \beta + MSF \times (1 - \beta)$$

wherein

WFD: feed water flow rate demand

WF: feed water flow rate

MSF: main steam flow rate $\beta$: constant, $0<\beta<1$

Although not shown in FIG. 2, the respective input gains on the feed water flow rate side and the main steam flow rate side of the adder 50 are $\beta$ and $(1-\beta)$ in the above formula.

A switch 51 selects the output A of the adder 21 or the output B of the adder 50 by a switching logic circuit 60. In an ordinary state, A, that is, the output of the adder 21, is selected. However, as will be described later, at the time of load runback, the switch 51 is changed over to B for a predetermined period of time when the water level begins to rise after having once been lowered below a predetermined value $(-\alpha)$ mm, thereby supplying the control system with a feed water flow rate demand signal, which is the output of the adder 50.

The following is a detailed description of how the signals A and B are changed over from one to the other. The reference numeral 52 denotes a signal comparator which detects the fact that load runback is in operation. As described above, the output of the subtractor 47 is positive during load runback, and the output of the comparator 52 is "1" in response thereto. A signal comparator 53 detects the fact that the drum water level is lower than the predetermined value $(-\alpha)$ mm. A time-delay circuit 54 delays the drum water level signal by an appropriate period of time. The output of the circuit 54 and the drum water level signal before it is delayed are compared with each other by a signal comparator 55, thereby detecting a rise in the drum water level.

Figure 3:
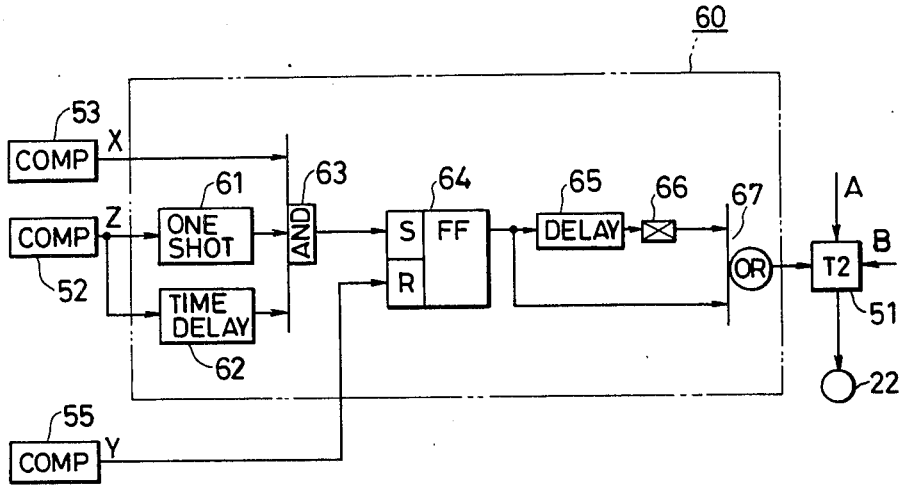
FIG. 3 shows a practical arrangement of the switching logic circuit shown in FIG. 2.
Figure 4:
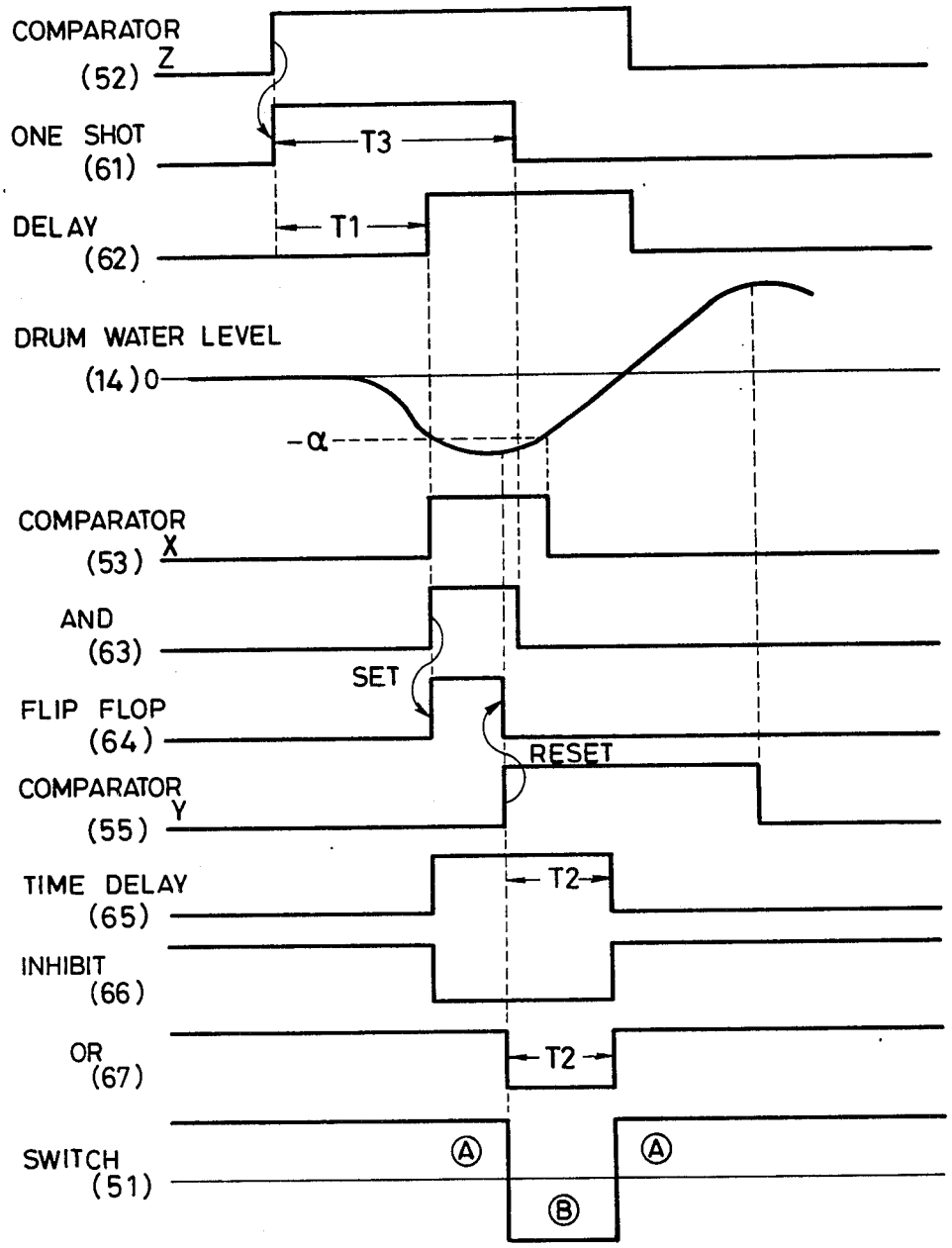
FIG. 4 shows changes with time of signals at various portions of the circuit shown in FIG. 3.

FIG. 3 shows the detail of the switching logic circuit 60 for the switch 51, while FIG. 4 shows waveforms representing the operation thereof. As described above, during load runback the load demand 41 is larger than the selected load reference, and the output of the signal comparator 52 is consequently "1". The reference numeral 61 denotes a one-shot element which outputs "1" for a predetermined period of time $T_3$ when its input is changed from "0" to "1", and thereafter the output is restored to "0". The numeral 62 represents a time-delay pickup in which, when its input is changed from "0" to "1" is output its changed to "1" after a predetermined time $T_1$. In both the two elements 61 and 62, when the input is "0", the output is "0". A combination of the comparator 52, the one-shot element 61 and the time-delay pickup 62 enables detection of the start of load runback.

The signal comparator 53, as is described above, detects the fact that the drum water level has fallen below the predetermined value $(-\alpha)$ mm, and outputs "1". An AND element 63 generates an output "1" when the drum water level becomes $-\alpha$ mm or less during load runback. A flip-flop element 64 stores the fact that the output of the AND element 63 has once become "1". As described above, the output of the signal comparator 55 represents the fact that the drum water level is rising. In other words, while the drum water level is rising, the output of the signal comparator 55 is "1". The flip-flop 64 is therefore reset, and its output is changed to "0". The reference numeral 65 denotes a time-delay element in which, when its input is inverted from "1" to "0", its output is changed to "0" after a predetermined time $T_2$ has passed. It is to be noted that, when the input of the time-delay element 65 is changed from "0" to "1", its output is also changed from "0" to "1" at the same time. The numeral 66 denotes an inhibit element, while 67 represents an OR element. By virtue of a combination of these logical elements, after the drum water level comes down to $-\alpha$ mm during load runback and when it starts to rise again, the output of the OR element 67 is "0" for the predetermined time $T_2$. The switch 51 selects the output of the B side, that is, the output of the adder 50 during the period $T_2$ when the output of the OR element 67 is "0". The feed water flow rate demand value within this period of time is therefore set at a medium value between the feed water flow rate and the main steam flow rate at the relevant time.

Figure 5:
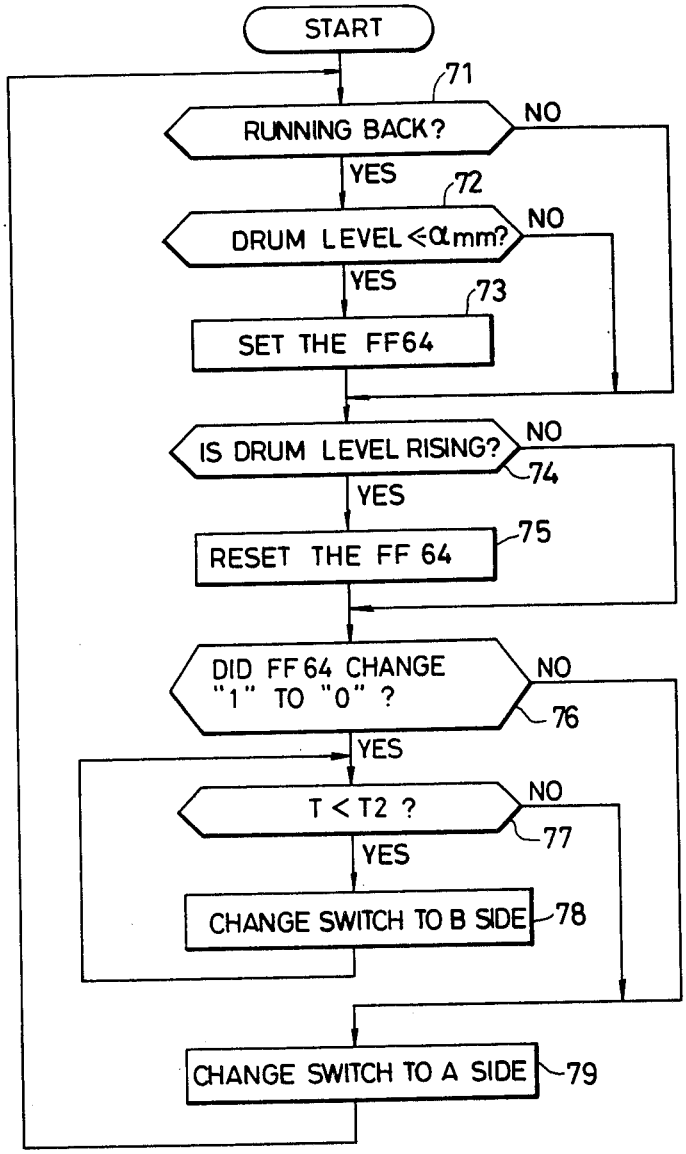
FIG. 5 is a flow chart employed when the functions of the circuit shown in FIG. 3 are realized by employing a computer.

Although in the above-described embodiment the invention is carried out by a wired logic circuit consisting of unit logical circuit elements, the invention may also be carried out by employing a computer. FIG. 5 is a flow chart employed when the invention is carried out by employing a computer. Referring to FIG. 5, a decision is made in Step 71 as to whether or not load runback is taking place. A decision is made in Step 72 as to whether or not the drum water level is below $-\alpha$ mm. The fact that the drum water level has lowered below $-\alpha$ mm during load runback is stored in the flip-flop (FF) 64 in Step 73. A decision is made in Step 74 as to whether or not the drum water level is rising. If YES, the flip-flop (FF) 64 is reset in Step 75. The change in state of the flip-flop 64 is judged in Step 76. If the state of the flip-flop 64 does not change from "1" to "0", the switch 51 changed to A in Step 79, while if the state of the flip-flop 64 has changed from "1" to "0", the process proceeds to Step 77. A decision is made in Step 77 as to whether or not the predetermined time $T_2$ has passed after the flip-flop 64 has changed from "1" to "0", and the switch 51 is changed to B during the predetermined time $T_2$ in Step 78. After the predetermined time $T_2$ has passed, the switch 51 is changed to A again in Step 79.

Figure 6A:
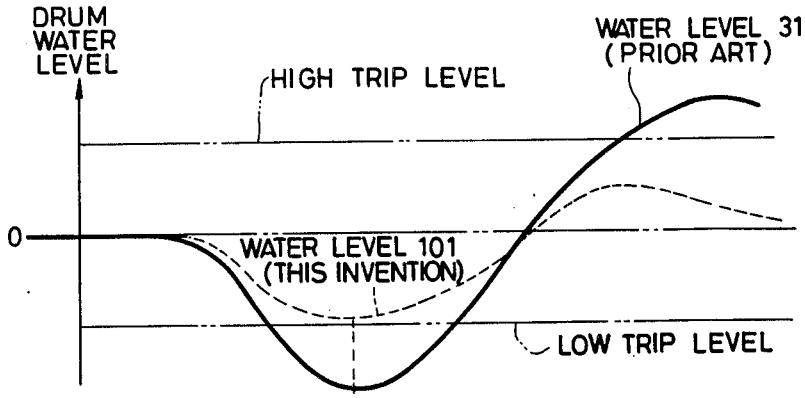
FIG. 6 shows the quantity of state of each of the sections of the plant having a drum type boiler to which the present invention is applied, FIG. 6(*a*) showing the drum water level, FIG. 6(*b*) showing the water flow and the main steam flow, and FIG. 6(*c*) showing the real load and the load reference.
Figure 6B:
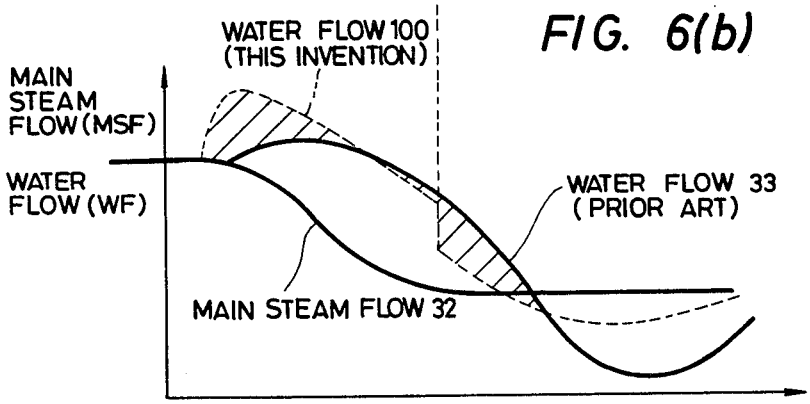
Figure 6C:
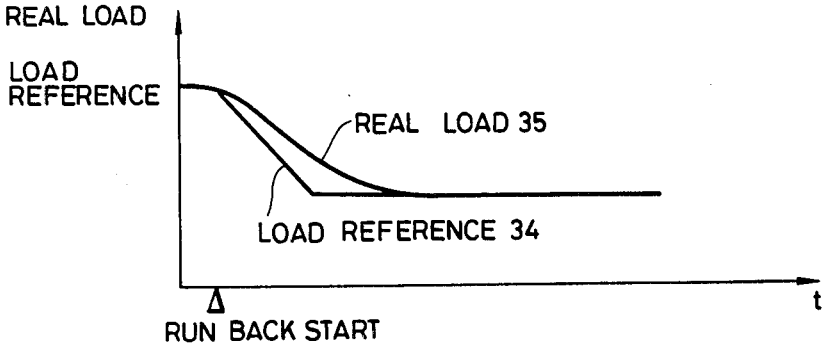

FIGS. 6(*a*) and 6(*b*) respectively show changes in the drum water level and the feed water flow rate by broken lines 101 and 100, while FIG. 6(*c*) shows how load runback is effected. The curve 100 in FIG. 6(*b*) is a response curve of the feed water flow rate in this embodiment. It is clear that feed water is supplied at the initial stage of load runback and, in contrast, rundown at the time when the drum water level starts to rise, at a time which is earlier than the prior art shown by the response curve 33 by the degree indicated by the hatched portions. As a result, the response of the drum water level is as is indicated by the curve 101, and both the fall of the drum water level at the initial stage of load runback and the rise in the water level after the end of runback are held down to a lower value than that of the prior art, thereby enabling prevention of the boiler system from being tripped off which might be caused by excessive rise in or fall of the drum water level.

According to the present invention, it is possible to suppress the fall of the drum water level in the initial stage of load runback by increasing the feed water flow rate to correspond to the amount of load reduction at the beginning of load runback, and also to suppress any rapid rise in the drum water level after the end of runback by reducing the feed water flow rate demand value to a medium value between the feed water flow rate and the main steam flow rate at the relevant time when the water level which has fallen during load runback starts to rise again. Thus, the feed water flow rate is reduced more rapidly than in the caes of a control system in which the feed water flow rate is controlled by the proportional plus integral action.

In other words, the present invention advantageously makes it possible to suppress the variation in the drum water level at the time of load runback and hence prevent the boiler system from being tripped off which would be caused by a drum water level above or below the upper or lower limit, respectively.

What is claimed is:

1. In an apparatus for controlling the drum water level of a drum type boiler having means for calculating a feed water flow rate demand value on the basis of a drum water level reference signal and a drum water level detecting signal, means for detecting a feed water flow rate, and means for controlling the feed water flow rate on the basis of the deviation of the feed water flow rate detecting signal from said feed water flow rate demand value such that said deviation becomes zero, an improvement characterized by comprising means for detecting the start of load runback, and means for increasing said feed water flow rate demand value in response to the detection of the start of load runback by said detecting means.

2. An apparatus according to claim 1, wherein the increment of said feed water flow rate demand value is determined in correspondence with the amount of load reduction caused by said load runback.

3. In an apparatus for controlling the drum water level of a drum type boiler having means for calculating a feed water flow rate demand value on the basis of a drum water level reference signal and a drum water level detecting signal, means for detecitng a feed water flow rate, and means for controlling the feed water flow rate on the basis of the deviation of the feed water flow rate detecting signal from said feed water flow rate demand value such that said deviation becomes zero, an improvement characterized by comprising means for detecting the start of load runback, means for increasing said feed water flow rate demand value in response to the detection of the start of load runback by said detecting means, means for detecting the fact that the drum water level is minimum, and means for decreasing said feed water flow rate demand value for a predetermined period of time after the minimum water level has been detected.

4. An apparatus according to claim 3, wherein the increment of said feed water flow rate demand value is determined in correspondence with the amount of load reduction caused by said load runback.

5. An apparatus according to either one of claims 3 and 4, wherein said feed water flow rate demand value decreased is set at a medium value between the feed water flow rate and the main steam flow rate at a relevant time.

6. An apparatus according to either one of claims 3 and 4, wherein said feed water flow rate demand value WFD is calculated from the following formula, wherein WF represents the feed water flow rate, MSF denotes the main steam flow rate at a relevant time, and $\beta$ is a constant between 1 and 0:

$$WFD = WF \times \beta + MSF \times (1-\beta).$$

* * * * *